US006041993A

United States Patent [19]

Matsuo et al.

[11] Patent Number: 6,041,993

[45] Date of Patent: Mar. 28, 2000

[54] METHOD AND APPARATUS OF CONTINUOUS ROLLING USING MULTIPLE SYNCHRONOUSLY MOVING WELDERS FOR TANDEN WELDING

[75] Inventors: Giichi Matsuo; Susumu Okawa, both of Yokohama; Hiroshi Fujii, Chigasaki, all of Japan

[73] Assignee: NKK Corporation, Tokyo, Japan

[21] Appl. No.: 08/876,650

[22] Filed: Jun. 16, 1997

[30] Foreign Application Priority Data

Jun. 28, 1996 [JP] Japan ..... 8-168864

[51] Int. Cl.[7] ..... B23K 37/00; B23K 31/00; B23K 31/02

[52] U.S. Cl. ..... 228/4.1; 228/5.7; 228/125; 228/178; 29/33 B

[58] Field of Search ..... 228/4.1, 125, 5.7, 228/26, 178; 29/33 B

[56] References Cited

U.S. PATENT DOCUMENTS

| | | | |
|---|---|---|---|
| 3,702,914 | 11/1972 | Noura | 219/73 |
| 3,870,853 | 3/1975 | Reinhardt et al. | 219/125 |
| 4,003,556 | 1/1977 | Roeder | 266/48 |
| 4,143,801 | 3/1979 | Sargent | 228/17.5 |
| 4,294,394 | 10/1981 | Lida et al. | 228/158 |
| 5,172,846 | 12/1992 | Hayashi et al. | 228/5.7 |
| 5,222,435 | 6/1993 | Thuerer et al. | 104/2 |

FOREIGN PATENT DOCUMENTS

| | | |
|---|---|---|
| 0 168 837 A2 | 1/1986 | European Pat. Off. . |
| 28 36 338 | 2/1980 | Germany . |
| 52-43754 | 4/1977 | Japan . |
| 57-11722 | 3/1982 | Japan . |
| 783225 | 9/1957 | United Kingdom . |
| 800860 | 9/1958 | United Kingdom . |

*Primary Examiner*—Patrick Ryan
*Assistant Examiner*—Kiley Stoner
*Attorney, Agent, or Firm*—Frishauf, Holtz, Goodman, Langer & Chick, P.C.

[57] ABSTRACT

A method for continuous rolling includes flash-butt welding to form a continuous billet by joining a rear end of a preceding billet with a front end of a succeeding billet, removing burrs from a welded portion of the joined part, and continuously rolling the joined continuous billet in a rolling mill group. The flash-butt welding step includes the use of two travelling welders arranged in series and spaced at a distance along the direction of movement of the continuous billet corresponding to the length of the billet being welded. The travelling welders synchronously move with the continuous billet, and separately and simultaneously weld the continuous billet to another billet by flash-butt welding so as to extend the length of the continuous billet.

3 Claims, 3 Drawing Sheets

METHOD AND APPARATUS OF CONTINUOUS ROLLING USING MULTIPLE SYNCHRONOUSLY MOVING WELDERS FOR TANDEN WELDING

BACKGROUND OF THE INVENTION

1. Field of the Invention

The present invention relates to a method of tandem welding type continuous rolling which conducts continuous rolling of a plurality of billets while joining them together in series by welding and an apparatus therefor.

2. Description of the Related Art

A known continuous rolling method to produce wire, rod, or shape steel with energy-saving and high efficiency comprises the steps of discharging billets from a heating furnace one at a time, welding the rear end of a preceding billet with the front end of a succeeding billet using a single unit of travelling flash-butt welder, removing the burr from the welded portions using a scarfer or the like, the thus formed continuous billet to a temperature necessary for rolling in an induction heating furnace, and continuously rolling the continuous billet in a rolling mill group: (disclosed in, for example, unexamined Japanese patent publication No.52-43754(1977)). Alternatively, there is a continuous rolling method in which billets discharged from a heating furnace are joined together by welding to form a continuous billet, and the continuous billet is heated again in the heating furnace, wherein a single unit of travelling flash-butt welder is used: (disclosed in, for example, examined Japanese patent publication No.52-11722(1982).

Shortening the cycle time for treating a single billet is an important issue in the continuous rolling of billets. In this respect, the weight of an ordinary billet is in a range of from 0.5 to 2 ton, and necessary cycle time to treat a single billet is within 1 min. to assure the production capacity of 70 to 80 ton/hr or more. Since conventional continuous rolling processes use only one on-line travelling flash-butt welder, as described above, the welding time inherent to the travelling flash-butt welder is difficult to shorten. Consequently, it is impossible to actualize the cycle time of less than 1 min. in the prior art.

SUMMARY OF THE INVENTION

An object of the present invention is to provide a method of continuous rolling which shortens the cycle time of billet treatment without requesting a large-scale modification of existing facilities, and to provide an apparatus therefor.

The method of continous rolling according to the present invention comprises the steps of: flash-butt welding to form a continuous billet by joining a rear end of a preceding billet with a front end of a succeeding billet; removing burr from a welded portion of a joined billet; and continuously rolling the joined continuous billet in a rolling mill group; wherein the flash-butt welding step is characterized in that a plurality of travelling welders are arranged in series at a distance therebetween corresponding to the length of the billet being treated along the moving direction of the billet while the plurality of travelling welders move synchronously with the movement of the continuous billet, and that the plurality of moving travelling welders separately and simultaneously weld the continuous billet with a plurality of billets by flash-butt welding to extend the length of the continuous billet.

An apparatus for continuous rolling according to the present invention comprises: a plurality of travelling welders which are arranged in series at a distance therebetween corresponding to the length of the billet being treated along the moving direction of the billet while the plurality of travelling welders move synchronously with the movement of a continuous billet at a rolling mill group side, and which separately and simultaneously weld the continuous billet with a plurality of billets discharged from a heating furnace by flash-butt welding to extend the length of the continuous billet; a travelling burr-removing machine to remove burr from each welded portion; and a rolling mill group which continuously rolls the continuous billet; wherein the plurality of travelling welders, the travelling grinding machine, and the rolling mill group are in linear arrangement.

DESCRIPTION OF THE PREFERRED EMBODIMENT

Figure 1:
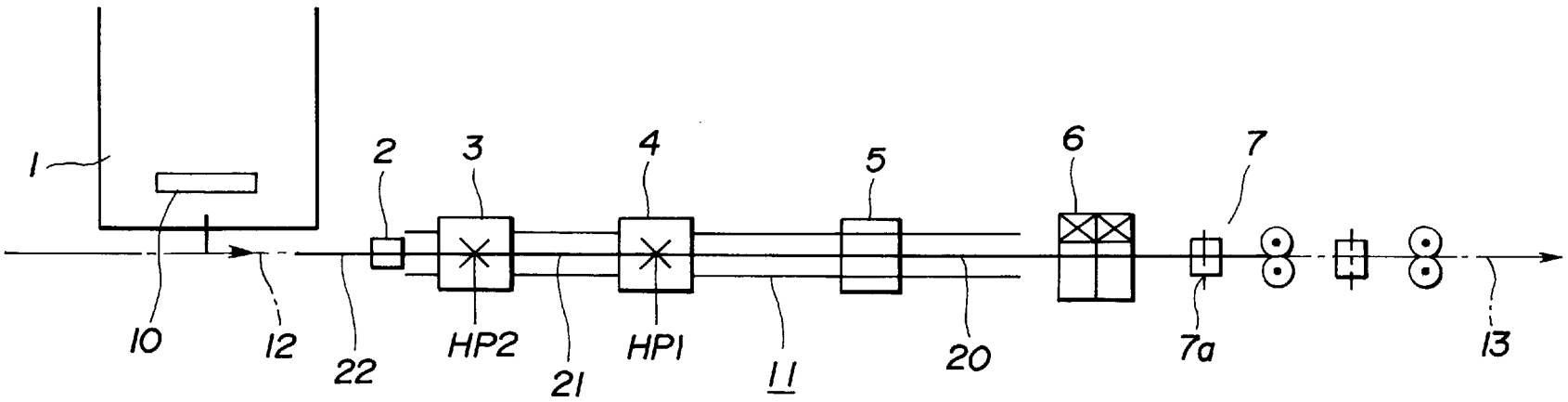
FIG. 1 illustrates a tandem welding type continuous rolling apparatus in mode 1 according to the present invention.

FIG. 1 illustrates a tandem welding type continuous rolling apparatus relating to the mode 1 according to the present invention. The tandem welding type continuous rolling apparatus comprises a heating furnace 1, a descaler 2, two travelling flash-butt welders (hereinafter referred to simply as "travelling welders") 3, 4, a travelling burr-removing machine 5, an induction heating unit 6, and a rolling mill 7. The rolling mill 7 comprises a plurality of stands, though the figure shows only the first stand 7*a*. A travelling grinding machine and/or a travelling cutting machine is/are used as the travelling burr-removing machine. In the tandem welding type continuous rolling apparatus, the continuation line 12 of billets 10 and the rolling line 13 in the rolling mill 7 match each other, and the descaler 2, the travelling welders 3,4, the travelling burr-removing machine 5, the induction heating unit 6, and the rolling mill 7 are located in linear arrangement on a single straight production line 11. The travelling welder 3 is divided into two sections, namely the rolling mill side and the counter rolling mill side at the welding point, and the travel (moving speed) of each is adjustable. The same mechanism is provided to the travelling welder 4.

The following is the description of function of the rolling apparatus shown in FIG. 1. At the time when the rear end of the continuous billet 20 which was formed by preliminarily joining the unit billets arrives at the home position HP1 on the travelling welder 4, both the first billet 21 which was discharged from the heating furnace in advance and the second billet 22 which was discharged from the heating furnace after the billet 21 are almost simultaneously sent to the joining line so as the front end of the first billet 21 comes to the home position HP1 of the travelling welder 4, and so as the rear end of the first billet 21 and the front end of the second billet 22 come to the home position HP2 on the travelling welder 3, and so as the first billet 21 and the second billet 22 catch up with the continuous billet 20, thus conducting simultaneous flash-butt welding when the first and second billets contact each other while synchronously moving the two travelling welders 3, 4, with the moving speed of the continuous billet 20.

A single unit of travelling burr-removing machine 5 is located at a down-stream side of the travelling welder 4 to remove the burr from the joined portion formed by the travelling welders 3, 4. Since the cycle time of burr-removal is 30 sec. or less, a single unit is sufficient as the travelling burr-removing machine 5. An induction heating unit 6 is located at the inlet of the first stand 7*a* of the rolling mill 7 to heat the cooled portion of the continuous billet 20. According to the mode, the necessary capacity of the heating unit 6 is less because of the time ranging from the point of billet discharge from the heating furnace to the point of billet arrival to the first stand 7*a* of the rolling mill 7.

A detailed description on the simultaneous welding process is given below. Welding begins at the point that the billets 20, 21, 22, contact each other. The billets 20, 21, 22, are clamped to begin the welding. The following-listed control actions are conducted during the welding step.

(1) The moving speed of the travelling welder (No. 1) 4 at the continuous billet 20 side is the same with the moving speed of the continuous billet 20.

(2) The counter-rolling mill side of the travelling welder (No. 1) 4 is under the distance control of the continuous billet 20 for performing flash-butt welding.

(3) The rolling mill side of the travelling welder (No. 2) 3 moves synchronously with (2).

(4) The counter-rolling mill side of the travelling welder (No. 2) 3 is under the distance control against the rolling mill side for performing flash-butt welding.

Figure 2:
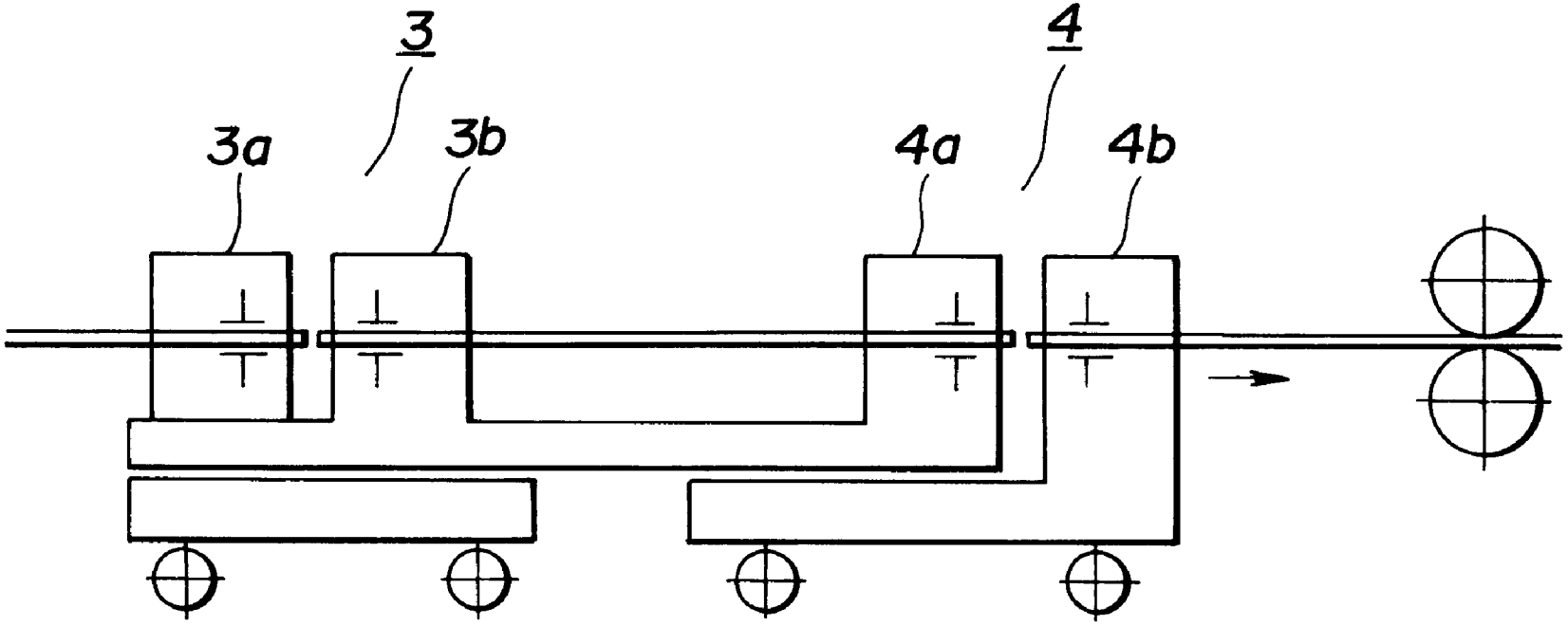
FIG. 2 shows an example of configuration of travelling welder in FIG. 1.

FIG. 2 shows an integrated configuration of the travelling welders 3 and the travelling welder 4 taking into account the above-described control items (1) through (4). As described above in (2) and (3), since the moving speed during welding is the same for both the counter-rolling mill side of the travelling welder 4 and the rolling mill side of the travelling welder 3, both sides are integrated to each other. That is, the travelling welder 4 is divided into the counter-rolling mill side 4*a* and the rolling mill side 4*b*. In similar manner, the travelling welder 3 is divided into the counter-rolling mill side 3*a* and the rolling mill side 3*b*. The counter-rolling mill side 4*a* of the travelling welder 4 and the rolling mill side 3*b* of the travelling welder 3 are unified together.

Figure 3:
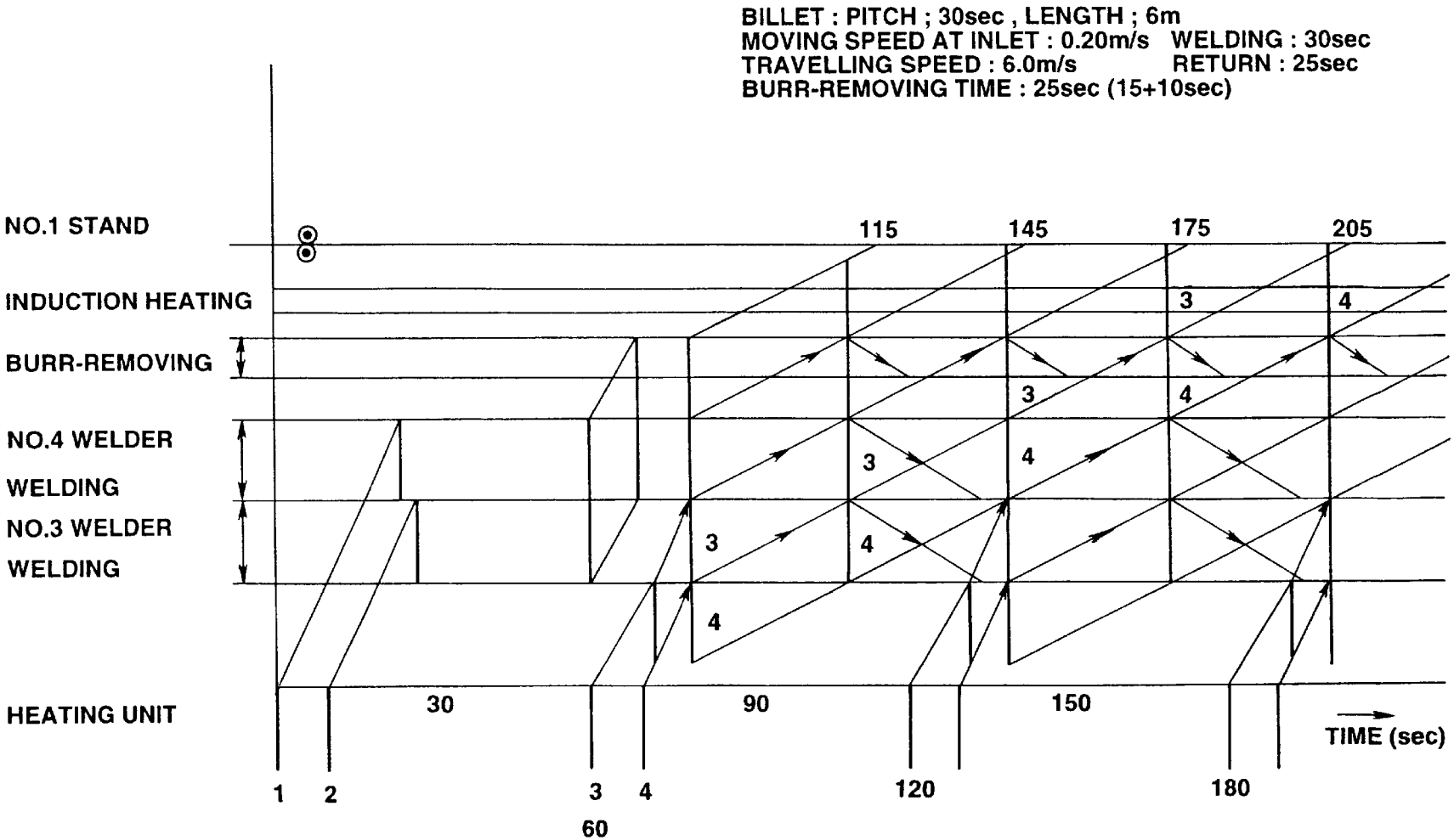
FIG. 3 is a time chart indicating the functions of the continuous rolling apparatus shown in FIG. 1, ranging from the discharge point of the billet from the heating furnace to the arrival point at the continuous rolling mill.

FIG. 3 shows a time chart indicating the functions of the continuous rolling apparatus shown in FIG. 1, ranging from the discharge point of billet 10 from the heating furnace 1 to the arrival point at the first stand 7*a* of the continuous rolling mill 7. According to the mode, two billets are welded simultaneously so that a shorter time interval of discharge of the two billets (for example, No.3 and No.4 billets (③ ④ in the chart) from the furnace is better and so the chart adopts 10 sec. as the billet discharge interval. As seen in the chart, the billets discharged at an average interval of 30 sec. become a continuous billet by the simultaneous welding at a welding cycle of 55 sec. in the travelling welders 3, 4, thus sent to the first stand 7*a* of the rolling mill 7. Furthermore, as described above, the period between the point of billet discharge from the furnace to the point of billet arrival at the first stand 7*a* is extremely short.

According to the example of FIG. 3, the period between the point of billet discharge from the heating furnace 1 and the point of billet arrival at the first stand 7*a* is 115 sec. for No. 1 billet and 135 sec. for No. 4 billet, which period is very short compared with that in the conventional method, or 200 sec. Accordingly, the temperature reduction of a billet between the discharge point and the arrival point is as small as 100° C. That is, if the billet is discharged from the heating furnace 1 at 1100° C., for example, the temperature of the billet at the point of arrival at the first stand is 950° C. or more without applying induction heating, which suggests the possibility of elimination of the induction heating unit 6 for reheating the billet.

As for the movement of the travelling welders 3, 4, and of the travelling burr-removing machine 5 shown in FIG. 3, each of them is located at a respective home position in the initial state, and begins to move at the start of welding and burr-removal, respectively, and returns to a respective home position after completing each treatment work.

The above-described mode deals with two travelling welders. The number of travelling welders may be, however, increased to three, four, and more.

FIG. 1 is an example in which the travelling welders are positioned between the heating furnace 1 and the continuous rolling mill 7. According to the present invention, however, a plurality of travelling welders may be located between a CCM unit treating relatively small size billets and a rolling mill to conduct continuous rolling of HDR method (or continuous rolling of billets directly charged from the continuous casting machine).

According to the present invention, a plurality of travelling welders are arranged in series at a distance therebetween corresponding to the length of the billet being treated along the moving direction of the billet while the plurality of travelling welders move synchronously with the movement of the continuous billet to separately and simultaneously weld the continuous billet with a plurality of billets by flash-butt welding to extend the length of the continuous billet. As a result, the shortening of cycle time for billet treatment is realized without requesting significant change in billet size in existing apparatus.

What is claimed is:

1. A method for continuous rolling to form a continuous billet comprising the steps of:

flash-butt welding to form a continuous billet by joining a rear end of a preceding billet with a front end of a succeeding billet;

removing burr from a welded portion of the continuous billet; and continuously rolling the joined continuous billet in a rolling mill group;

wherein the flash-butt welding step is characterized by arranging a plurality of travelling welders in series having a distance therebetween, in the moving direction of the continuous billet, corresponding to the length of a billet being welded, moving the plurality of travelling welders synchronously with the continuous billet, and operating the plurality of travelling welders to separately and simultaneously weld the continuous billet to a corresponding plurality of billets by flash-butt welding to extend the length of the continuous billet.

2. The method of claim 1, further comprising the step of: successively discharging from a heating furnace a plurality of billets which correspond in number to the plurality of the travelling welders.

3. Apparatus for continuous rolling to form a continuous billet comprising:

a plurality of travelling welders arranged in series having a distance therebetween, in the moving direction of the continuous billet, corresponding to a length of a billet being treated, the plurality of travelling welders moving synchronously with the continuous billet at a rolling mill group side, the plurality of travelling welders separately and simultaneously welding the continuous billet to a plurality of billets discharged from a heating furnace by flash-butt welding so as to extend the length of the continuous billet;

a travelling burr-removing machine to remove burr from each welded portion of the continuous billet; and a rolling mill group which continuously rolls the continuous billet, wherein the plurality of travelling welders, the travelling burr-removing machine, and the rolling mill group are linearly arranged.

* * * * *

UNITED STATES PATENT AND TRADEMARK OFFICE

CERTIFICATE OF CORRECTION

PATENT NO. : 6,041,993
DATED : March 28, 2000
INVENTOR(S) : Giichi Matsuo et al.

It is certified that error appears in the above-identified patent and that said Letters Patent is hereby corrected as shown below:

Title page,
Item [56], References Cited, insert -- OTHER PUBLICATIONS STAHL UND EISEN, Vol. 78, No. 16, 7 August, 1958, pp. 1130-1132, XP002028327, WEIDEMANN, H: "DAS AUSWALZEN 'ENDLOS' ZUSAMMENGESCHWEISSTER KNUEPPEL"- Figures 2, 3. --.

Signed and Sealed this

Ninth Day of October, 2001

*Attest:*

Nicholas P. Godici

*Attesting Officer*

NICHOLAS P. GODICI
*Acting Director of the United States Patent and Trademark Office*